US006439187B1

(12) United States Patent
Dietz et al.

(10) Patent No.: US 6,439,187 B1
(45) Date of Patent: Aug. 27, 2002

(54) MECHANICAL COMPRESSION RELEASE

(75) Inventors: James R. Dietz, New Holstein; Anthony P. Freund, Fond du Lac, both of WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/710,241

(22) Filed: Nov. 10, 2000

Related U.S. Application Data

(60) Provisional application No. 60/166,064, filed on Nov. 17, 1999.

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | | |
|---|---|---|---|---|
| 3,362,390 | A | 1/1968 | Esty | 123/182.1 |
| 3,381,676 | A | 5/1968 | Campen | 123/182.1 |
| 3,395,689 | A | 8/1968 | Kruse | 123/182.1 |
| 3,496,922 | A | 2/1970 | Campen | 123/182.1 |
| 3,897,768 | A | 8/1975 | Thiel | 123/182.1 |
| 4,241,620 | A | 12/1980 | Pichl et al. | 74/573 R |
| 4,252,092 | A | 2/1981 | Kaufman et al. | 123/182.1 |
| 4,672,930 | A | 6/1987 | Sumi | 123/182.1 |
| 4,696,266 | A | 9/1987 | Harada | 123/182.1 |
| 4,898,133 | A | 2/1990 | Bader | 123/182.1 |
| 4,977,868 | A | 12/1990 | Holschuh | 123/182.1 |
| 5,184,586 | A | 2/1993 | Buchholz | 123/182.1 |
| 5,197,422 | A | 3/1993 | Oleksy et al. | 123/182.1 |
| 5,301,643 | A | 4/1994 | Garcyalny | 123/198 D |
| 5,687,683 | A | 11/1997 | Knoblauch | 123/182.1 |
| 5,711,264 | A | 1/1998 | Jezek et al. | 123/182.1 |
| 5,809,958 | A | 9/1998 | Gracyalny | 123/182.1 |
| 5,823,153 | A | 10/1998 | Santi et al. | 123/182.1 |

FOREIGN PATENT DOCUMENTS

| | | | |
|---|---|---|---|
| EP | 0 515 183 | 11/1992 | |
| JP | 59-043913 | 3/1984 | |
| JP | A 62-265414 | 11/1987 | 123/182.1 |
| WO | WO 01/61157 | 8/2001 | |

*Primary Examiner*—Andrew M. Dolinar
(74) *Attorney, Agent, or Firm*—Baker & Daniels

(57) ABSTRACT

A compression release mechanism for an internal combustion engine wherein a rotatable pin positioned axially parallel to the camshaft is rotatably received in the cams, and has a lift member mounted at an axial end thereof. The pin is non-cylindrically shaped at one axial end thereof, and the non-cylindrically shaped end is received and secured into a correspondingly shaped bore disposed in a cylindrical hub extending perpendicularly from a one-piece flyweight. An optional adhesive can be used to secure the pin to the hub of the flyweight. According to a further optional embodiment, the hub can be crimped so as to engage the release pin. The disclosed configuration ensures a secure engagement and therefore avoids slipping between the release pin and the flyweight. Further, the design facilitates easy alignment of the pin with the flyweight during assembly. The flyweight can be a one-piece integral structure.

23 Claims, 4 Drawing Sheets

MECHANICAL COMPRESSION RELEASE

RELATED APPLICATIONS

The application is based on U.S. Provisional Patent Application Ser. No. 60/166,064, filed Nov. 17, 1999, the complete disclosure of which is hereby expressly incorporated by reference.

BACKGROUND OF THE INVENTION

This invention relates generally to internal combustion engines, and more particularly to an improved compression release mechanism for single cylinder, four stroke engines.

Compression release mechanisms are well known in the art. Generally, means are provided to hold one of the valves in the combustion chamber of the cylinder head slightly open during the compression stroke while cranking the engine. This action partially relieves the force of compression in the cylinder during starting, so that starting torque requirements of the engine are greatly reduced. When the engine starts and reaches running speeds, the compression release mechanism is rendered inoperable so that the engine may achieve full performance. It is normally advantageous for the compression release mechanism to be associated with the exhaust valve so that the normal flow of the fuel/air mixture into the chamber through the intake valve, and the elimination of spent gases through the exhaust valve is not interrupted, and the normal direction of flow through the chamber is not reversed.

Examples of compression release mechanisms for four-stroke engines are shown in U.S. Pat. Nos. 3,381,676; 3,496,922; 3,897,768; and 4,977,868, all assigned to the assignee of the present application.

U.S. Pat. No. 4,977,868, the disclosure of which is hereby incorporated by reference, discloses a compression release mechanism for an internal combustion engine wherein a rotatable compression release pin is positioned axially parallel to the camshaft and rotatably received in the cams disposed on the cam shaft. The pin has an auxiliary cam surface mounted at an axial end thereof to extend beyond the outboard cam to engage one of the valve lifters at low engine speed. The other cylindrically-shaped axial end of the pin is press fit into a matching cylindrical bore in a cylindrical hub which extends perpendicularly from the flyweight. Undesirably, this arrangement could result in the compression release pin coming loose from the hub, in which event the auxiliary cam surface becomes misaligned. Further, in production, alignment of the pin within the bore in the hub is critical, but precise alignment is difficult to achieve.

An improved compression release mechanism that overcomes the above difficulties is desirable. Accordingly, it is desired to provide a compression release mechanism that is effective in operation and relatively simple in construction, and that may be utilized to actuate the exhaust valve in an internal combustion engine.

SUMMARY OF THE INVENTION

The present invention provides a mechanical compression release including a compression release pin that is non-cylindrically shaped at one axial end thereof. The non-cylindrically shaped end is received and secured into a correspondingly shaped bore disposed in a cylindrical hub extending perpendicularly from a one-piece flyweight. This configuration avoids the slipping problem described above, and the pin is much easier to align during assembly.

In one form thereof, the present invention provides a compression release mechanism for relieving compression during engine starting in an internal combustion engine having a camshaft rotatably disposed within a housing, the camshaft having inboard and outboard cams and a cam gear disposed thereon. The mechanism comprises a flyweight having a hub extending substantially perpendicularly therefrom. A non-cylindrically shaped bore is disposed in the hub. A release pin that has a first end having a shape corresponding to the bore is received in the bore. The release pin has a lift member at a second axial end thereof, which is adapted to selectively engage a valve lifter.

In a preferred form thereof, the corresponding shape is a D-shape, and the flyweight is integrally formed in one piece. Further, the release pin is also integrally formed in one piece. Optionally, an adhesive can be applied to the bore within the hub and the adhesive is activated when the first end of the pin is inserted into the bore.

According to another optional form, the end of the release pin which is inserted into the bore of the hub includes a small flat portion or a groove into which the hub is compressed or deformed by crimping so as to secure the release pin in the bore of the hub. In this embodiment, the end of the release pin that is received into the bore can be cylindrical or non-cylindrical.

In yet another optional form, the release pin includes a groove that is configured to receive a retaining ring or clip therein. In this later form, a retaining ring or clip can be used to secure the release pin in position.

An advantage of the present invention is that it provides an effective compression release mechanism that is operable to significantly reduce the cranking effort required to start an internal combustion engine without thereby sacrificing engine power and engine running speeds.

Another advantage of the present invention is that the non-cylindrically shaped bore and correspondingly shaped axial end of the release pin fit securely together so that the release pin does not become misaligned after a period of use.

Yet another advantage of the present invention is that it is much easier to assemble than prior art designs. The corresponding shapes of the non-cylindrical bore and axial end of the release pin ensure that the release pin can only be installed into the hub of the flyweight in a properly aligned position. Time-consuming alignment procedures are therefore unnecessary with the present invention.

A further advantage of the above invention is that it provides a compression release mechanism which is economical in construction and highly reliable in operation.

Another advantage of the present invention is that the flyweight is formed in one piece from nicad-zinc and will not rust.

BRIEF DESCRIPTION OF THE DRAWINGS

The above-mentioned and other advantages and objects of this invention, and the manner of attaining them, will become more apparent and the invention itself will be better understood by reference to the following description of embodiments incorporating the invention taken in conjunction with the accompanying drawings, wherein.

Figure 1:
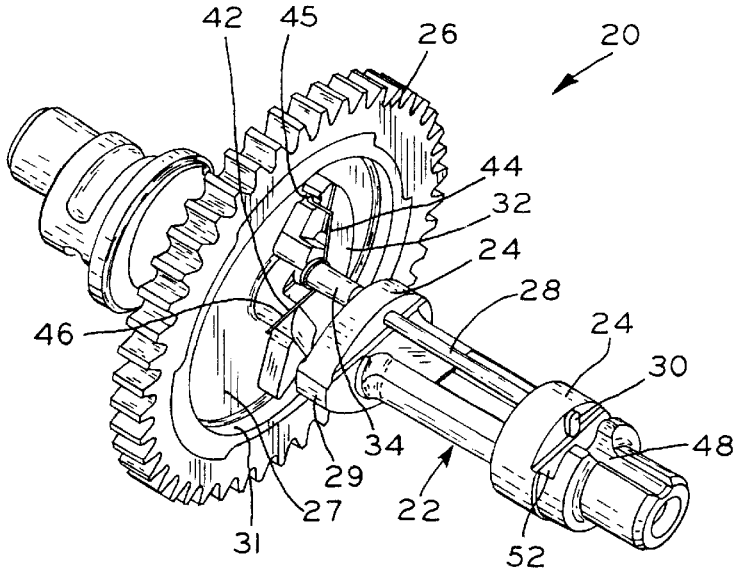
FIG. 1 is a perspective view of the compression release mechanism in accordance with the present invention, showing its relation to the camshaft.
Figure 2A:
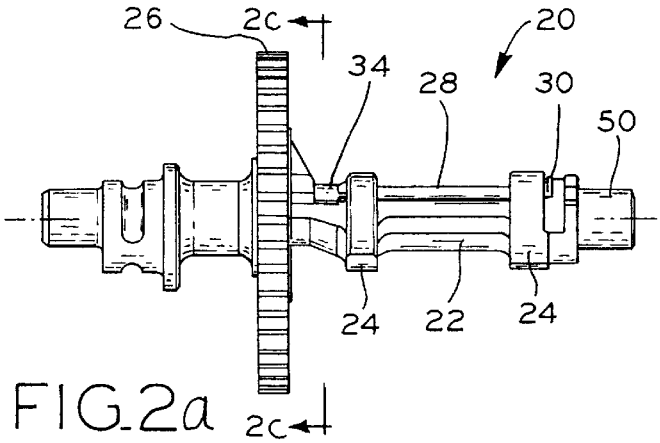
FIGS. 2*a*–2*d* are elevational views of the compression release mechanism in accordance with the present invention.
Figure 2B:
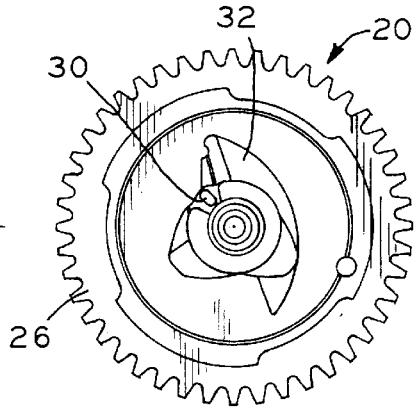
Figure 2C:
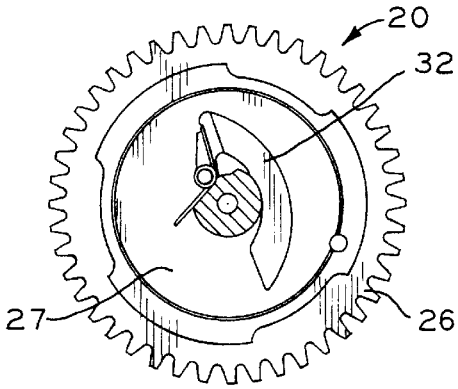
Figure 2D:
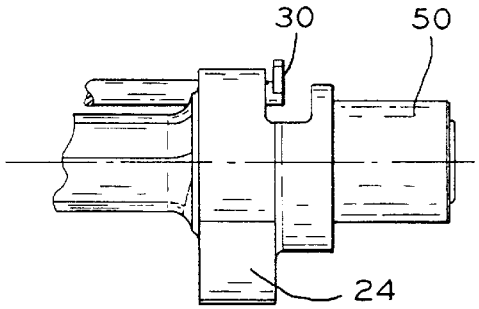

Corresponding reference characters indicate corresponding parts throughout the several views. Although the drawings represent embodiments of the invention, the drawings are not necessarily to scale and certain features may be exaggerated in order to better illustrate and explain embodiments incorporating the present invention.

DETAILED DESCRIPTION

Referring to FIG. 1, compression release assembly 20 includes camshaft 22 having cams 24 thereon as is known in the art. Cam gear 26 is formed from plastic and is molded onto wheel member 27 which is attached to camshaft 22. Gear 26 engages a gear of the crankshaft (not shown), as is well known in the art. Valve actuation devices (not shown) are vertically displaced by the lobes 29 on cams 24 as camshaft 22 operates at normal operating speeds as is known in the art.

With further reference to FIG. 1, the compression release mechanism includes a compression release pin 28 that is rotatably received within cylindrical bores in each of the cams 24. Pin 28 has an outer bearing surface and is positioned axially parallel to camshaft 22. On the outboard axial end of pin 28 is disposed a lift member 30 that is oriented as shown in FIG. 1 to engage a corresponding valve tappet (not shown) at low engine speed. Between inboard cam 24 and gear 26 is disposed a flyweight 32 in an annular pocket 31 defined by cam wheel 27. Flyweight 32 is molded in one-piece from nicad-zinc and includes a hub 34 extending substantially perpendicularly therefrom.

Figure 3A:
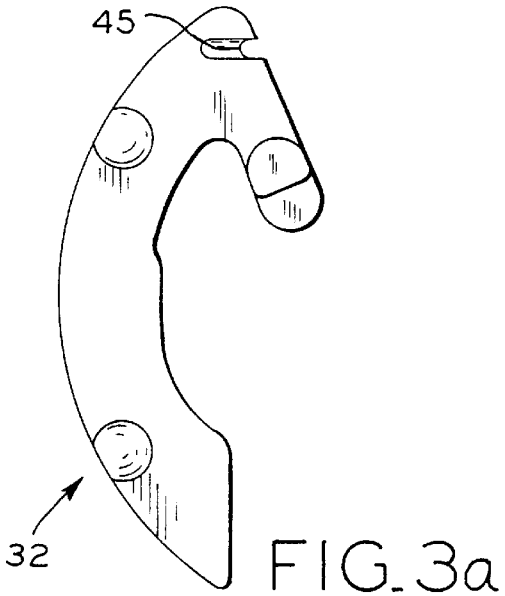
FIGS. 3*a*–3*c* are views of a flyweight in accordance with the present invention.
Figure 3B:
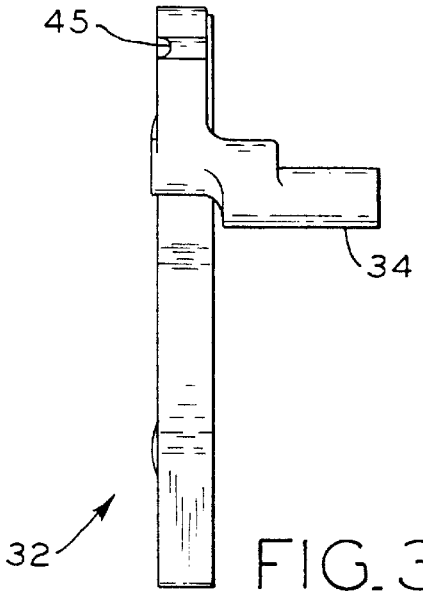
Figure 3C:
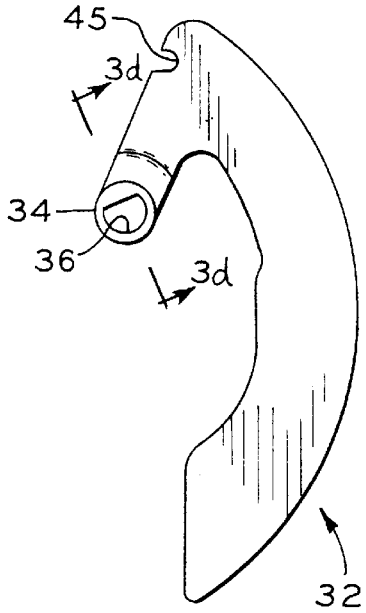
Figure 3D:
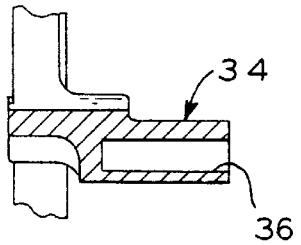
FIG. 3*d* is a fragmentary view in partial section illustrating a hub of the flyweight shown in FIGS. 3*a*–3*c;*

Flyweight 32 can be better appreciated with reference to FIGS. 3*a*–3*d,* where it can be seen that flyweight 32 is shaped in a boomerang configuration so that when camshaft 22 rotates above a minimum speed, flyweight 32 is biased outwardly and pin 28 rotates therewith (FIG. 1). With reference to FIG. 3*b,* cylindrical hub 34 extends substantially perpendicularly from the flyweight, and as shown in FIGS. 3*c* and 3*d,* hub 34 includes a non-cylindrically shaped bore 36 disposed therein. Although shown as a D-shape in the illustrated embodiment, it will be readily recognized by one of ordinary skill that other non-cylindrical shapes could be employed for the shape of bore 36.

Figure 4A:
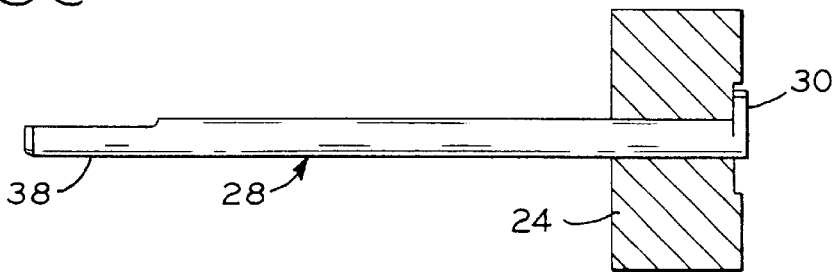
FIGS. 4*a* and 4*b* are front and side elevational views of the mechanical compression release pin in accordance with the present invention.
Figure 4B:
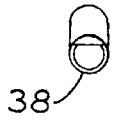
Figure 7:
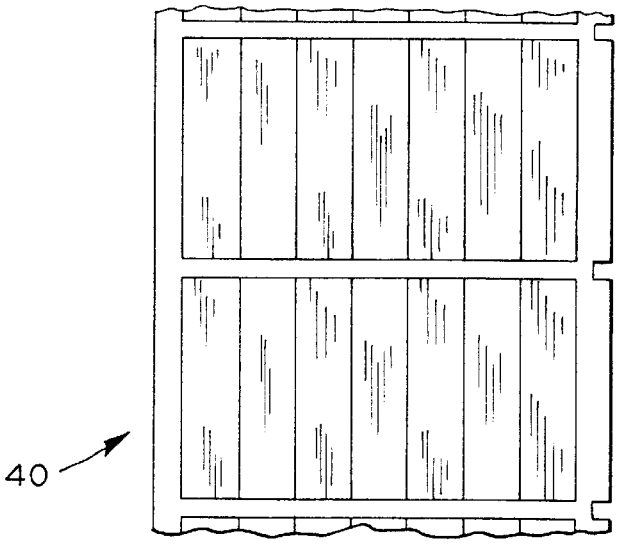
FIG. 7 illustrates an adhesive suitable for use with embodiments incorporating the present invention.

With reference to FIGS. 4*a*–4*b,* release pin 28 includes a D-shaped axial end 38 which corresponds to cylindrically shaped bore 36. The length of D-shaped end 38 is slightly longer than bore 36, and bore 36 and end 38 are sized to fit together via a friction fit. Preferably, end 38 is crimped before insertion into bore 36 to produce a more secure fit. Optionally, an adhesive 40 shown in FIG. 7 is applied to the inside of bore 36 and is activated by pressure when pin 28 is inserted into bore 36. While many adhesives would be suitable in the practice of the present invention, one preferred adhesive is available in strip form from saf-T-Lok Corporation under part number R35.

As shown in FIG. 1, camshaft 22 includes a groove 48 formed at the outboard end thereof to facilitate installation of the release pin 28 during assembly. Groove 48 also extends partially into outboard cam 24. Camshaft 22 also includes a slot 52 disposed orthogonally to groove 48 to allow lift member 30 to rotate during assembly and operation of the compression release mechanism.

Figure 6A:
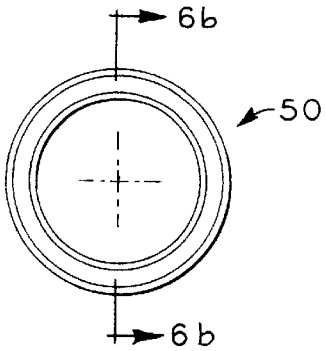
FIGS. 6*a* and 6*b* illustrate a bushing in accordance with the present invention.
Figure 6B:
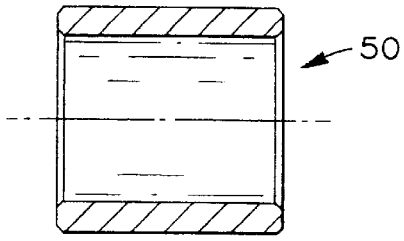

During assembly, spring 42 is inserted over hub 34 and the flyweight 32 is tilted about 15 degrees relative to cam gear 26 so that flyweight 32 can be inserted against cam wheel 27, into pocket 31 defined by cam wheel 27. Next, the D-shaped 25 end 38 of pin 28 is slid through the corresponding bores formed in each of the cams 24, clearance therefor being provided by groove 48. Lift member 30 is then oriented such that the D-shape of end 38 inserts into D-shaped bore 36, thereby ensuring proper alignment of pin 28 with flyweight 32. End 38 is crimped after being inserted into bore 36. Optionally, adhesive 40 is applied to bore 36 before insertion of D-shaped 30 end 38. Flyweight 32 is thus sandwiched between cam wheel 27 on one end, and the inboard cam 24 abuts against hub 34 on the opposite side of flyweight 32. Finally, a bushing 50 as shown in FIG. 6 is press fit over the outboard axial end of camshaft 22 to provide means for camshaft 22 to rotate within the housing (not shown).

Figure 4C:
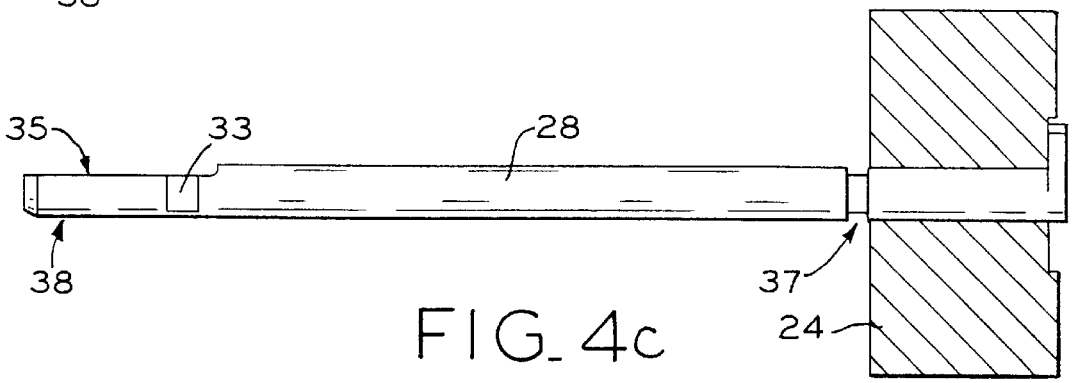
FIG. 4*c* is a side elevational view of the mechanical compression release pin in accordance with an alternative embodiment of the present invention.

FIG. 4*c* depicts a mechanical compression release pin in accordance with an alternative embodiment of the present invention. In this embodiment, the D-shaped axial end 38 of release pin 28 includes a small flat area 33. Flat area 33 is depicted as having a planar surface that is substantially perpendicular to the flat portion 35 of axial end 38 of release pin 28 which defines the D-shape thereof.

During assembly, after the D-shape of end 38 is inserted into D-shaped bore 36, thereby ensuring proper alignment of pin 28 with flyweight 32, the hub 34 is crimped in a portion adjacent flat area 33. The crimping of hub 32 causes the inner surface of hub 32 to be compressed or deformed into flat area 33 and thereby secures release pin 28 in position.

The flat area 33 can have a different orientation to that described above, but should be distinct from the flat portion 35 of axial end 38 of release pin 28 which defines the D-shape thereof. Other cut or machined structures such as grooves, rings, bores, etc. can be used as alternatives to flat area 33.

Figure 8:
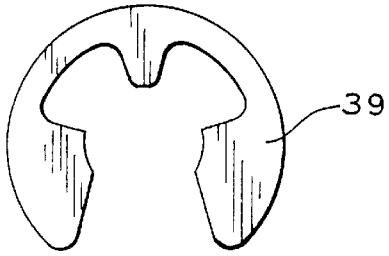
FIG. 8 is an end view of a retaining ring or clip that can be used to secure the release pin into the compression release mechanism of the present invention.

The release pin depicted in FIG. 4*c* includes an annular groove 37 toward the outboard end thereof. Annular groove 37 is configured to receive a retaining ring or clip 39 (FIG. 8). As depicted, annular groove 37 is located along the release pin 28 at a position where a retaining ring or clip 39 attached therein will abut the inward side of outboard cam 24. Annular groove 37 and its associated retaining ring or clip 39 can be used in combination with any of the release pins 28 described herein, including those that are secured in bore 36 or hub 34 by adhesive 40.

FIG. 8 is an end view of a retaining ring or clip that can be used to secure the release pin into the compression release mechanism of the present invention. The retaining ring or clip 39 can be of conventional design. Such retaining rings or clips 39 are often made of spring steel and, depending on their shapes, are sometimes referred to as C-clips, D-clips or E-clips.

Figure 5A:
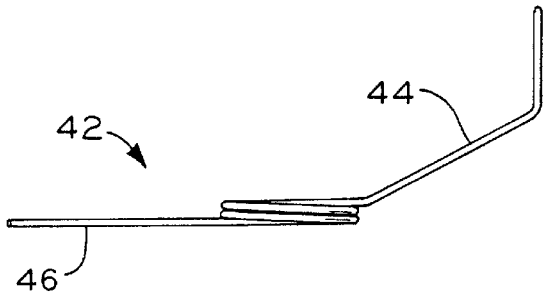
FIGS. 5*a* and 5*b* illustrate a flyweight spring in accordance with the present invention.
Figure 5B:
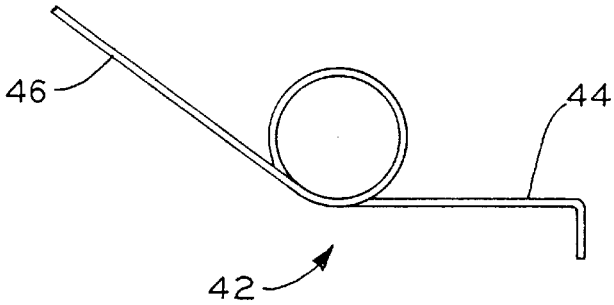

As shown in FIG. 1, and in more detail in FIGS. 5*a* and 5*b,* a coil spring 42 is positioned around cylindrical hub 34 and includes a spring arm 44 that bears against flyweight 32 to bias flyweight 32 to the position shown in FIG. 1. Arm 44 is received in annular groove 45 formed in flyweight 32 as shown in FIGS. 3*a*–3*c*. The other arm 46 of spring 42 bears against camshaft 22.

The operation of the above-described compression relief mechanism is entirely automatic and is determined by engine speed. To start the engine, the operator manually cranks the engine in the usual manner, such as with a pull rope starter, to turn the engine over at a relatively low cranking speed. The pre-load of spring 42 biases flyweight 32 to the position shown in FIG. 1. With flyweight 32 in this position, rotatable release pin 28 and lift member 30 are oriented such that lift member 30 extends radially beyond the confines of the outboard cam 24 as shown in FIG. 1. During initial cranking of the engine, as camshaft 22 rotates at a relatively low speed, lift member 30 engages the flat underside of a valve actuation device (not shown) during each rotation of camshaft 22, which lifts a corresponding exhaust valve (not shown) slightly off its seat for a portion of each compression stroke. As soon as the engine has started and is running under its own power, the rotational speed of camshaft 22 increases above the cranking speed, and flyweight 32, as it revolves with camshaft 22, overcomes spring 42 and pivots outwardly from the start position as shown in FIG. 1 to a "run" position (not shown), wherein the flyweight has pivoted outwardly and release pin 28 has rotated therewith such that lift member 30 has rotated approximately 90 degrees and therefore no longer extends radially beyond the outboard cam 24. Thus, during normal running speeds of the engine, the compression release mechanism is deactivated. As the engine is brought to a stop, the centrifugal force acting on flyweight 32 is no longer strong enough to overcome the bias of spring 42, and flyweight 32 thus will return to the position shown in FIG. 1.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A compression release mechanism for relieving compression during engine starting in an internal combustion engine having a camshaft rotatably disposed within a housing, the camshaft having inboard and outboard cams and a cam gear disposed thereon, said mechanism comprising:

a flyweight having a hub extending substantially perpendicularly therefrom, a non-cylindrically shaped bore disposed in said hub; and a release pin disposed substantially axially parallel to the camshaft, said release pin including a first end having a shape corresponding to said bore, said first end received in said bore, said release pin having a lift member disposed at a second end thereof, said lift member adapted to selectively engage a valve actuation device, and further comprising an adhesive proximate said first end of said release pin, wherein said release pin is adhesively secured to said flyweight.

2. A compression release mechanism for relieving compression during engine starting in an internal combustion engine having a camshaft rotatably disposed within a housing, the camshaft having inboard and outboard cams and a cam gear disposed thereon, said mechanism comprising:

a flyweight having a hub extending substantially perpendicularly therefrom, a non-cylindrically shaped bore disposed in said hub; and a release pin disposed substantially axially parallel to the camshaft, said release pin including a first end having a shape corresponding to said bore, said first end received in said bore, said release pin having a lift member disposed at a second end thereof, said lift member adapted to selectively engage a valve actuation device, wherein the release pin includes an annular groove within which a retaining ring is received to thereby retain the release pin in the compression release mechanism.

3. The compression release mechanism of claim 2, wherein said complementary shape is a D-shape.

4. The compression release mechanism of claim 2, wherein said flyweight is integrally formed in one piece.

5. The compression release mechanism of claim 2, wherein said release pin is integrally formed in one piece.

6. The compression release mechanism of claim 2, wherein said release pin is rotatably received through the inboard and outboard cams.

7. The compression release mechanism of claim 2, wherein said lift member is disposed adjacent a side of the outboard cam, said side facing away from the cam gear.

8. A compression release mechanism for relieving compression during engine starting in an internal combustion engine having a camshaft rotatably disposed within a housing, the camshaft having inboard and outboard cams and a cam gear disposed thereon, said mechanism comprising:

a one-piece flyweight having a hub extending substantially perpendicularly therefrom, a bore disposed in said hub; and a release pin including a first end having a shape matching said bore, said first end received in said bore, said release pin having a lift member disposed at a second end thereof, said lift member adapted to selectively engage a valve actuation device, said release pin rotatably disposed through the inboard and outboard cams, and further comprising an adhesive proximate said first end of said release pin, wherein said release pin is adhesively secured to said flyweight.

9. A compression release mechanism for relieving compression during engine starting in an internal combustion engine having a camshaft rotatably disposed within a housing, the camshaft having inboard and outboard cams and a cam gear disposed thereon, said mechanism comprising:

a one-piece flyweight having a hub extending substantially perpendicularly therefrom, a bore disposed in said hub; and a release pin including a first end having a shape matching said bore, said first end received in said bore, said release pin having a lift member disposed at a second end thereof, said lift member adapted to selectively engage a valve actuation device, said release pin rotatably disposed through the inboard and outboard cams, wherein the release pin includes an annular groove within which a retaining ring is received to thereby retain the release pin in the compression release mechanism.

10. The compression release mechanism of claim 9, wherein the one-piece flyweight is an integrally molded structure.

11. The compression release mechanism of claim 9, wherein the one-piece flyweight is molded from nicad-zinc.

12. The compression release mechanism of claim 9, wherein the bore in the hub has a non-cylindrical shape.

13. The compression release mechanism of claim 9, wherein the bore is D-shaped.

14. The compression release mechanism of claim 9, wherein said release pin is rotatably received through the inboard and outboard cams.

15. The compression release mechanism of claim 9, wherein said lift member is disposed adjacent a side of the outboard cam, said side facing away from the cam gear.

16. A compression release mechanism for relieving compression during engine starting in an internal combustion engine having a camshaft rotatably disposed within a housing, the camshaft having inboard and outboard cams and a cam gear disposed thereon, said mechanism comprising:

a one-piece flyweight having a hub extending substantially perpendicularly therefrom, a bore disposed in said hub; and a release pin including a first end having a shape matching said bore, said first end received in said bore and secured therein by crimping a portion of the hub against the first end of the release pin, said release pin having a lift member disposed at a second end thereof, said lift member adapted to selectively engage a valve actuation device, said release pin rotatably disposed through the inboard and outboard cams.

17. The compression release mechanism of claim 16, wherein the crimped portion of the hub is deformed against the release pin.

18. The compression release mechanism of claim 16, wherein the release pin is provided with a non-cylindrical portion against which the hub is deformed.

19. The compression release mechanism of claim 18, wherein the release pin is provided with a groove into which the hub is deformed.

20. The compression release mechanism of claim 16, wherein the one-piece flyweight is an integrally molded structure.

21. The compression release mechanism of claim 16, wherein the release pin includes an annular groove within which a retaining ring is received to thereby retain the release pin in the compression release mechanism.

22. The compression release mechanism of claim 16, wherein said release pin is rotatably received through the inboard and outboard cams.

23. The compression release mechanism of claim 16, wherein said lift member is disposed adjacent a side of the outboard cam, said side facing away from the cam gear.

* * * * *